US008858300B2

(12) United States Patent
Cellier et al.

(10) Patent No.: US 8,858,300 B2
(45) Date of Patent: Oct. 14, 2014

(54) APPLYING DIFFERENT PRESSURES THROUGH SUB-PAD TO FIXED ABRASIVE CMP PAD

(75) Inventors: Glenn L. Cellier, Hopewell Junction, NY (US); Laertis Economikos, Wappingers Falls, NY (US); Timothy M. McCormack, Pleasant Valley, NY (US); Rajasekhar Venigalla, Hopewell Junction, NY (US)

(73) Assignee: International Business Machines Corporation, Armonk, NY (US)

( * ) Notice: Subject to any disclaimer, the term of this patent is extended or adjusted under 35 U.S.C. 154(b) by 938 days.

(21) Appl. No.: 12/702,333

(22) Filed: Feb. 9, 2010

(65) Prior Publication Data

US 2011/0195640 A1 Aug. 11, 2011

(51) Int. Cl.

| | |
|---|---|
| ***B24B 5/00*** | (2006.01) |
| ***B24B 37/00*** | (2012.01) |
| ***B24B 37/16*** | (2012.01) |
| ***B24B 37/24*** | (2012.01) |
| ***B24B 37/22*** | (2012.01) |

(52) U.S. Cl.

CPC ..... *B24B 37/16* (2013.01); *B24B 37/245* (2013.01); *B24B 37/22* (2013.01)

USPC ..... 451/288; 451/388

(58) Field of Classification Search

USPC ..... 451/288, 289, 388, 533, 537, 539

See application file for complete search history.

(56) References Cited

U.S. PATENT DOCUMENTS

| | | | | |
|---|---|---|---|---|
| 6,033,293 | A * | 3/2000 | Crevasse et al. | 451/494 |
| 6,267,659 | B1 * | 7/2001 | Chen et al. | 451/533 |
| 6,485,359 | B1 * | 11/2002 | Li et al. | 451/289 |
| 7,025,660 | B2 | 4/2006 | Taylor et al. | |
| 8,167,687 | B2 * | 5/2012 | Nakamura et al. | 451/57 |

* cited by examiner

*Primary Examiner* — Dung Van Nguyen

(74) *Attorney, Agent, or Firm* — Yuanmin Cai; Hoffman Warnick LLC

(57) ABSTRACT

A chemical mechanical polishing (CMP) system includes a rotating polishing table including a platen providing at least two pressure zones having different pressures; a sub-pad positioned on the platen, the sub-pad including a plurality of openings allowing for transmission of the different pressures therethrough; a fixed abrasive pad positioned on the sub-pad; and a pressure-creating system sealingly coupled to the platen for creating a different pressure in the at least two pressure zones, wherein the different pressures create topography on the fixed abrasive pad. A sub-pad and related method are also provided.

9 Claims, 4 Drawing Sheets

APPLYING DIFFERENT PRESSURES THROUGH SUB-PAD TO FIXED ABRASIVE CMP PAD

BACKGROUND

1. Technical Field

The disclosure relates generally to wafer polishing, and more particularly, to a fixed abrasive chemical mechanical polishing system, sub-pad therefor and method employing different pressures applied through the sub-pad to a rotating pad that contacts the wafer.

2. Background Art

Fixed abrasive chemical mechanical planarization (FA CMP) has been used in production of integrated circuit (IC) chips for several years, and across many technologies starting from 90 nanometer (nm) and continuing to 32 nm and 22 nm nodes. FA CMP includes using a rotating pad including abrasives fixed therein with a slurry that does not include abrasives for polishing (i.e., planarizing) a surface of a wafer.

One issue in implementing FA CMP is that the removal rate varies and decreases as topography is reduced. This situation causes under-polish of the wafer which results in having to scrap affected wafers/lots. Several processes have been tried to increase removal rate. In one approach, ribs were placed on the sub-pad under the abrasive pad to create topography on the abrasive pad. Here, the size and spacing of the ribs is larger than that of the fixed abrasives on the abrasive pad, causing the pad to bend between the ribs so some of the fixed abrasives are not contacting the wafer. To overcome this problem, increased down force is used which causes increased scratching of the wafer. Another approach includes using chemistries that increase the friction on the wafer in order to boost oxide removal rate. This method also increases scratches.

BRIEF SUMMARY

A first aspect of the disclosure provides a chemical mechanical polishing (CMP) system comprising: a rotating polishing table including a platen providing at least two pressure zones having different pressures; a sub-pad positioned on the platen, the sub-pad including a plurality of openings allowing for transmission of the different pressures therethrough; a fixed abrasive pad positioned on the sub-pad; and a pressure-creating system sealingly coupled to the platen for creating a different pressure in the at least two pressure zones, wherein the different pressures create topography on the fixed abrasive pad.

A second aspect of the disclosure provides a sub-pad for a fixed abrasive chemical mechanical polishing (CMP) pad, the sub-pad comprising: a layer of material having a plurality of openings having dimensions sufficient to allow a pressure differential to pass from a platen therefor to the fixed abrasive CMP pad.

A third aspect of the disclosure provides a method comprising: rotating a first side of a rotating pad, including fixed abrasives therein, as the rotating pad is applied to a wafer to polish the wafer; and applying at least two different pressures to a second side of the rotating pad to create a topography of the first side of the rotating pad.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION

As indicated above, the disclosure provides a chemical mechanical polishing (CMP) system, sub-pad therefor and a related method that applies different pressures through the sub-pad to a fixed abrasive rotating pad to create topography on the rotating pad. Among other advantages, embodiments of the invention enhance fixed abrasive removal rate without altering the process consumables, i.e., chemistry, polishing pad, sub-pad, etc.

Figure 1:
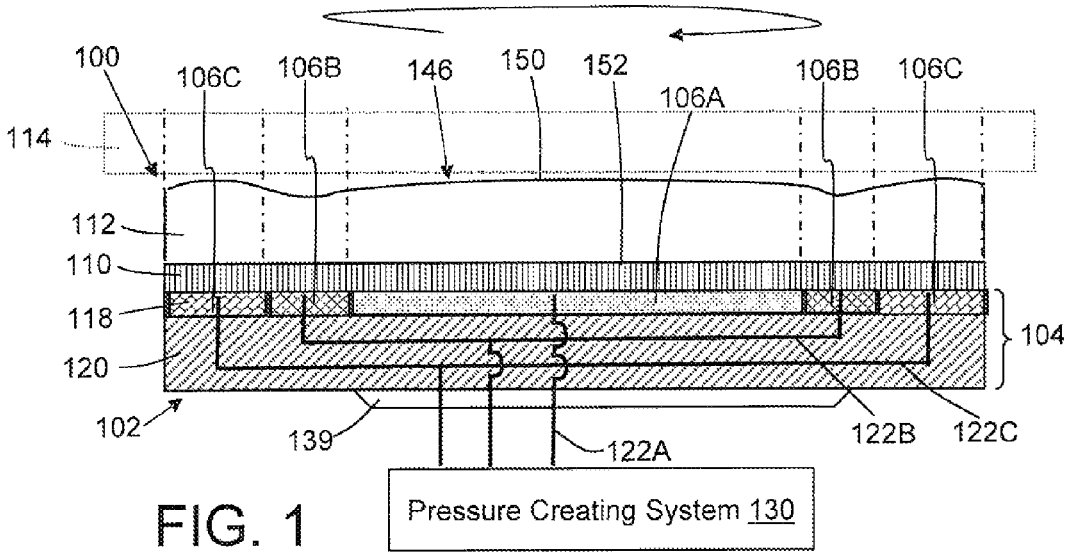
FIG. 1 shows a schematic cross-sectional view of a fixed abrasive chemical mechanical polishing (CMP) system according to embodiments of the invention.

Referring to FIG. 1, a schematic cross-sectional view of a CMP system 100 according to embodiments of the invention is provided. As understood in the art, CMP is a method of removing layers of material by chemical-mechanical polishing for planarizing a surface and/or defining metal interconnect patterns on a wafer 114. CMP is routinely used in back-end-of-line integrated circuit manufacturing. Fixed abrasive CMP uses abrasive particles that are fixed in a polishing pad rather than dispersed in a slurry that is applied to the wafer.

In one embodiment, CMP system 100 includes a rotating polishing table 102 including a platen 104 providing at least two pressure zones 106A-C having different pressures. A sub-pad 110 is provided over platen 104, and a fixed abrasive rotating pad 112 is provided over sub-pad 110. A wafer 114 is shown in phantom over rotating pad 112.

Figure 2:
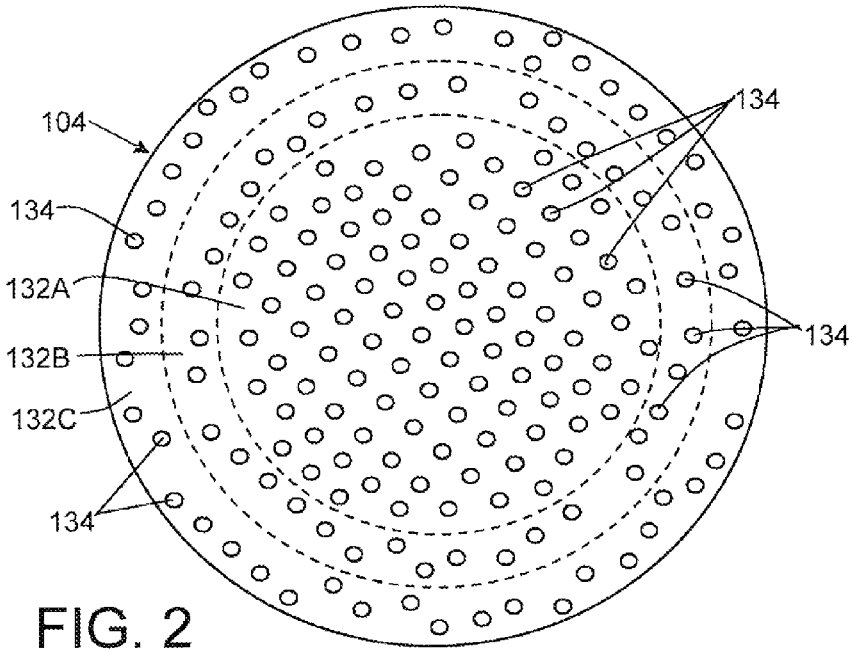
FIG. 2 shows a top view of one embodiment of a platen for the CMP system of FIG. 1.

Rotating polishing table 102 may include any now known or later developed structure for supporting rotating pad 112 and creating rotation thereof, e.g., supports, a motor (not shown), etc. Platen 104 may be a separate member from the rest of rotating table 102 or may be integral thereto. Different pressure zones 106A-C created by platen 104 are illustrated as different shading in an upper portion 118 of platen 104 compared to a lower portion 120 thereof. However, platen 104 is typically a unitary member. In FIGS. 1-2, three pressure zones are provided. A pressure-creating system 130 may be sealingly coupled to platen 104 for creating a different pressure in pressure zones 106A-C. That is, pressure-creating system 130 is secured against leakage sufficiently to deliver enough pressurized gas to platen 104 to cause the different pressure zones, e.g., through piping, passages in platen 104, seals, etc. Pressure-creating system 130 may include a vacuum system or a pressurization system, e.g., a pneumatic or gas vacuum or pump system, capable of creating the at least two pressure zones 106A-C.

Figure 3:
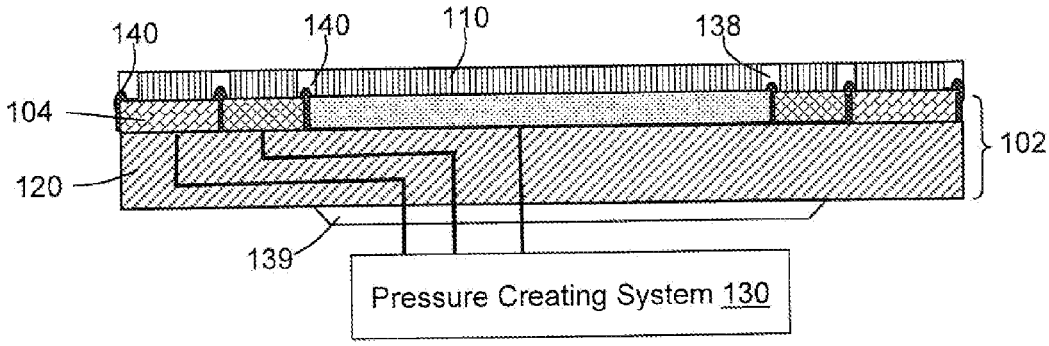
FIG. 3 shows a schematic cross-sectional view of a fixed abrasive CMP system according to another embodiment of the invention.
Figure 4:
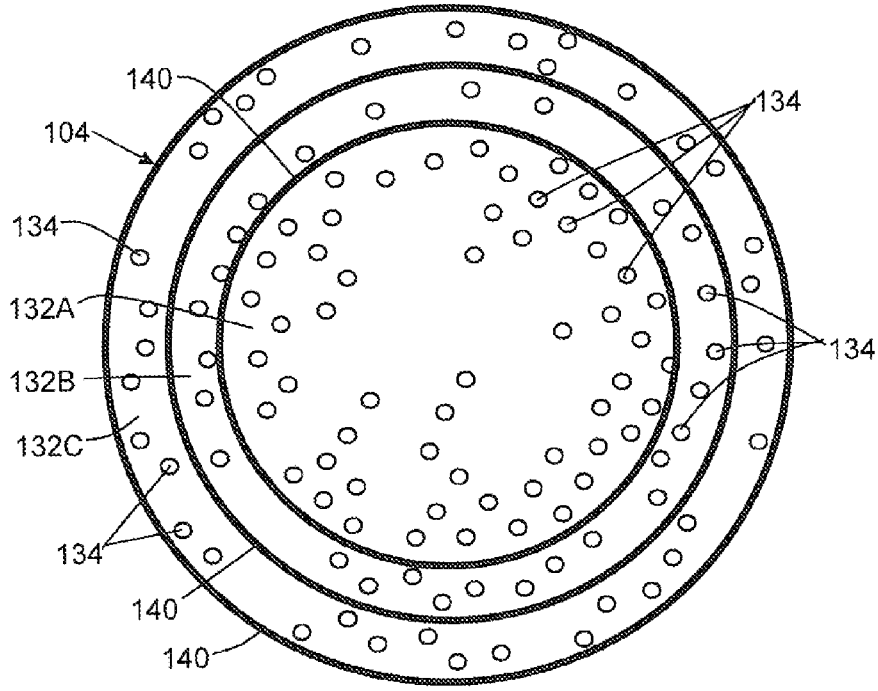
FIG. 4 shows a top view of an alternative embodiment of a platen for the CMP system of FIG. 3.

The different pressure zones 106A-C may be created in or by platen 104 in a variety of different ways. In one embodiment, as shown in FIG. 2, platen 104 may include a number of defined regions 132A-C having openings 134 in fluid (gas) communication with passages 122A-C (FIG. 1) in platen 104. That is, passages 122A-C convey gas to openings 134. That is, pressure zones 106A-C as defined by regions 132A-C may be created simply by passages 122A-C communicating with each opening 134 and by the different pressures applied therethrough. Alternatively, as shown in FIGS. 3-4, structures such as ribs 140 or other structure at a surface of platen 104 may be provided to fluidly separate the regions, creating manifolds (same location as 132A-C). In this case, not as many passages 122A-C or openings 134 may be required since the pressure will be communicated within zones 106A-C (defined regions 132A-C) by ribs 140. If the latter option is used, then as shown in FIG. 3, sub-pad 110 may include complementary structure 138 to accommodate ribs 140 or other structure creating the manifolds.

Figure 6:
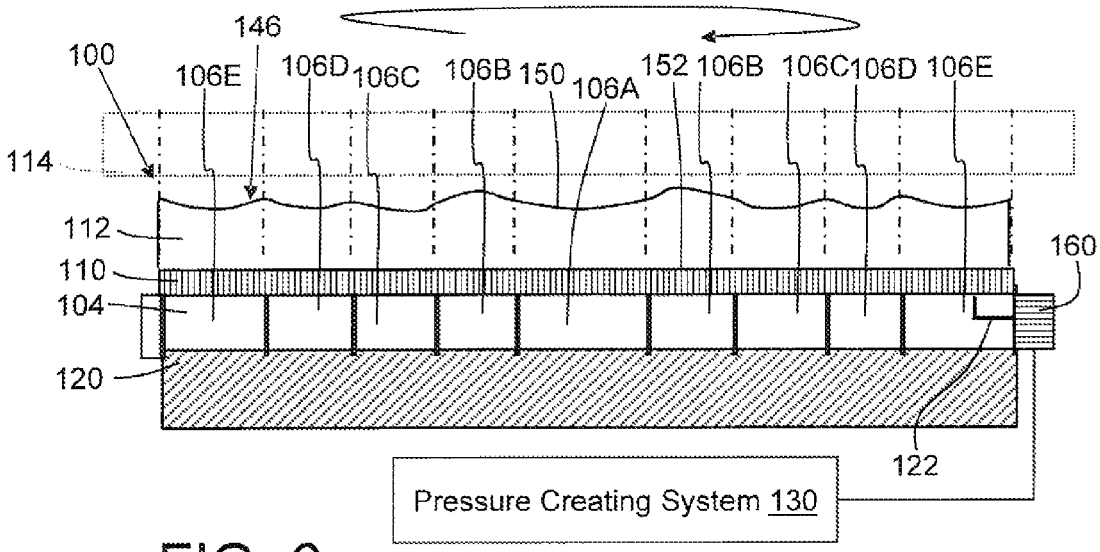
FIG. 6 shows a schematic cross-sectional view of a fixed abrasive CMP system according to another embodiment of the invention.
Figure 7:
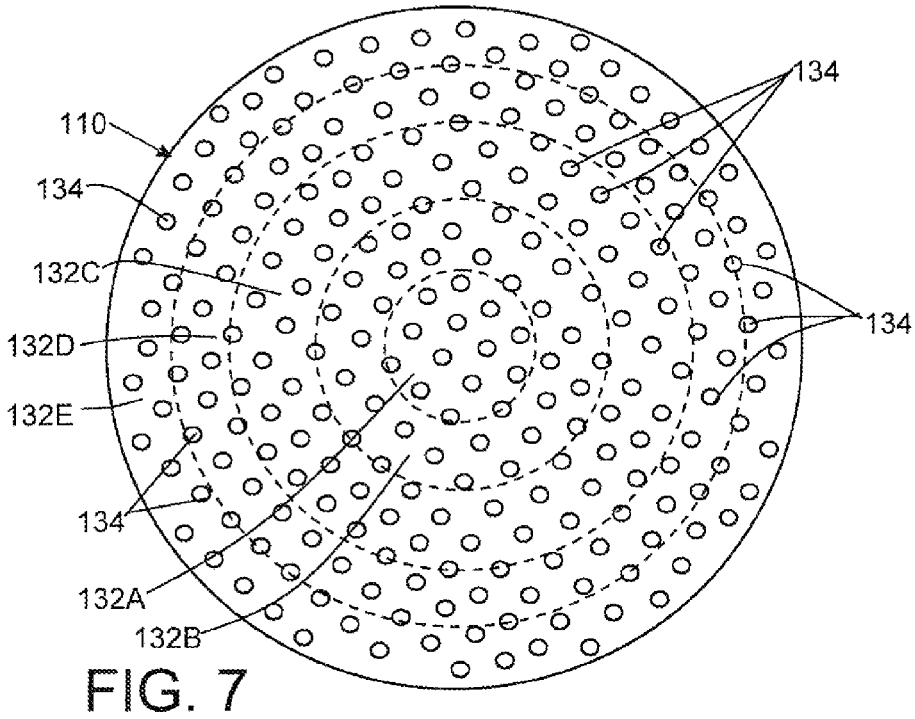
FIG. 7 shows a top view of a sub-pad of the CMP system of FIG. 6.

If necessary, any now known or later developed manifold 139 for sealingly coupling pressure-creating system 130 to rotating table 102 and/or platen 104 may be implemented. In the FIG. 1 embodiment, manifold 139 may be positioned below platen 104. Alternatively, as shown in FIG. 6, a manifold 160 that interacts with openings in a side of platen 104 may be used. For example, manifold 160 may have pressurized segments that sealingly and fluidly communicate through circumferential grooves in a periphery of platen 104 that have passages 122 (only one shown in FIG. 6) that communicate to openings 134 (FIG. 7). While two examples of how pressurized zones 106 being created via platen 104 are illustrated, the teachings of the invention are not limited to such as a variety of other mechanisms may be possible.

Pressure zones 106A-C (106A-E in FIG. 6) and defined regions 132A-C (132A-E in FIG. 7) are illustrated as concentric regions in the drawings. It is emphasized, however, that the pressure zones do not necessarily have to be concentric or in a circular shape. For example, the defined regions 132 could be polygonal in shape. Furthermore, openings 134 are arranged in a random manner within defined regions 132A-C, but can be arranged in a circular or more uniform manner than that shown.

Figure 5:
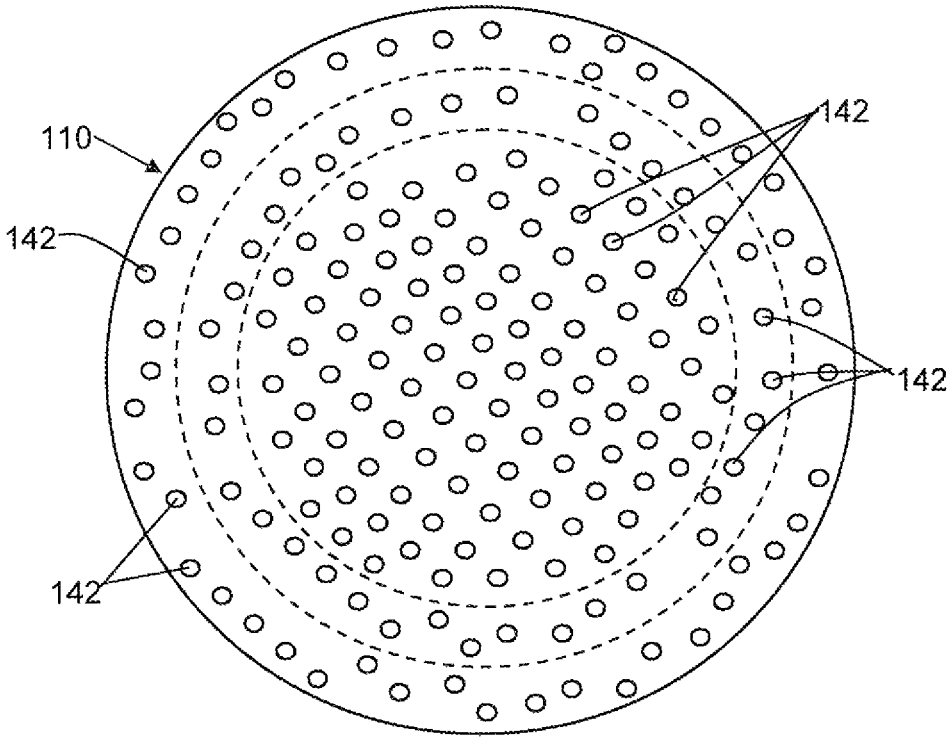
FIG. 5 shows a top view of a sub-pad according to an embodiment of the invention.

With further reference to FIGS. 1, 3 and 5, sub-pad 110 is positioned on platen 104 and includes a layer of material having a plurality of openings 142 (FIG. 5) having dimensions sufficient to allow a pressure differential to pass from platen 104 to rotating pad 112. That is, plurality of openings 142 (FIG. 5) allow for transmission of the different pressures through sub-pad 110. Sub-pad 110 may include any now known or later developed material. Openings 142 may occur naturally in the material or may be formed therein, e.g., by drilling or other penetrating technique. Furthermore, openings 142 are illustrated arranged in a random manner, but can be arranged in a circular or more uniform manner than that shown. The size of the openings may be dependent on any of a variety of parameters such as but not limited to: pressure creating system 130 power, stiffness of sub-pad 110, stiffness of rotating pad 112, etc.

Referring to FIG. 1, fixed abrasive rotating pad 112 is positioned on sub-pad 110. Fixed abrasive pad 112 may include any now known or later developed CMP pad having fixed abrasives therein.

In operation, as shown in FIGS. 1 (and 6), a first side 150 of rotating pad 112 including fixed abrasives therein, is rotated by rotating table 102 as the rotating pad is applied to wafer 114 to polish the wafer. As also shown in FIG. 1 in an exaggerated manner for ease of observation, at least two different pressure zones 106A-C are applied to a second side 152 of rotating pad 112 to create a topography 146 of fixed abrasive rotating pad 112 in first side 150 of rotating pad 112. That is, the different pressures passing through sub-pad 110 to fixed abrasive pad 112 create topography 146 on the fixed abrasive pad. Topography 146 allows fixed abrasive posts (not labeled) in abrasive rotating pad 112 to contact wafer 114 during polishing while a pressure differential between pressure zones 106A-C enhances removal rate. The pressures employed may vary depending on the type of CMP being performed using system 100. In one embodiment, pressure-creating system 130 creates at least one pressure that is lower than atmospheric pressure, e.g., 14.7 pounds per square inch (psi). In another embodiment, each pressure is in the range of approximately 0.01 psi to approximately 14 psi. Alternatively, vacuum pressure can be applied to different zones, e.g., approximately −0.01 psi to approximately −14 psi. That is, an overall range of approximately −14 psi to approximately 14 psi can be applied. In addition, in one embodiment, pressure-creating system 130 may change at least one pressure in pressure zones 106A-C during operation, which may create a dynamic or moving topography 146 across first side 150 of rotating pad 112 and thus wafer 114 as wafer 114 is polished.

While FIGS. 1-5 illustrate system 100 including three different pressure zones 106A-C, it is emphasized that the teachings of the invention are not so limited. That is, CMP system 100 may include less than three pressure zones, i.e., two pressure zones, or more pressure zones. For example, FIG. 6 shows five pressure zones 106A-E. By increasing the number of pressure zones 106 or the frequency of pressure change among the zones, removal rate can be enhanced and maintained.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A chemical mechanical polishing (CMP) system comprising:

a rotating polishing table including a platen providing at least two pressure zones having different pressures;

a sub-pad positioned on the platen, the sub-pad including a plurality of openings allowing for transmission of the different pressures therethrough;

a fixed abrasive pad positioned on the sub-pad;

a pressure-creating system sealingly coupled by a manifold to the platen for creating a different pressure in the at least two pressure zones, wherein the manifold sealingly communicates through a plurality of circumferential grooves in a periphery of the platen, and wherein the different pressures create topography on the fixed abrasive pad; and a plurality of passages for conveying gas to the at least two pressure zones, wherein each passage conveys a gas at one of the different pressures, and wherein each passage comprises a connection to the pressure creating system and at least two branches for delivering a same pressure.

2. The CMP system of claim 1, wherein the pressure-creating system creates at least one pressure that is lower than atmospheric pressure.

3. The CMP system of claim 1, wherein each pressure is in the range of approximately −14 pounds per square inch (psi) to approximately +14 psi.

4. The CMP system of claim 1, wherein the at least two pressure zones includes at least three pressure zones.

5. The CMP system of claim 1, wherein the pressure-creating system changes at least one pressure in the at least two pressure zones during operation.

6. A method comprising:

rotating a first side of a rotating pad on a platen, including fixed abrasives therein, as the rotating pad is applied to a wafer to polish the wafer;

conveying a gas through a plurality of passages to at least two pressure zones, wherein each passage conveys a gas at one of at least two different pressures, and wherein each passage comprises a connection to a pressure creating system sealingly coupled by a manifold to the platen and at least two branches for delivering a same pressure, wherein the manifold sealingly communicates through a plurality of circumferential grooves in a periphery of the platen; and applying at least two different pressures to a second side of the rotating pad to create a topography of the first side of the rotating pad.

7. The method of claim 6, wherein the applying includes creating at least two pressure zones on the second side through a sub-pad that supports the rotating pad.

8. The method of claim 6, wherein the applying includes changing the at least two different pressures during the rotating.

9. The method of claim 6, wherein the applying includes applying at least five different pressures to the second side.

* * * * *